United States Patent [19]

Figari

[11] Patent Number: 4,727,701

[45] Date of Patent: Mar. 1, 1988

[54] BUILDING PANEL

[76] Inventor: Andres G. Figari, Calle 77 - 801 Apto 302, Bogota, Colombia

[21] Appl. No.: 795,765

[22] Filed: Nov. 7, 1985

Related U.S. Application Data

[63] Continuation-in-part of Ser. No. 462,434, Jan. 31, 1983, Pat. No. 4,573,303.

[30] Foreign Application Priority Data

Jan. 29, 1982 [GB] United Kingdom ..... 8202562

[51] Int. Cl.[4] ..... E04B 1/04; E04C 1/30; E04C 2/04; E04C 2/50

[52] U.S. Cl. ..... 52/587; 52/259; 52/583; 52/588; 52/787

[58] Field of Search ..... 52/588, 587, 583, 258, 52/259, 260, 309.2, 787

[56] References Cited

U.S. PATENT DOCUMENTS

| | | | |
|---|---|---|---|
| 1,087,644 | 2/1914 | Crane . | |
| 1,236,387 | 8/1917 | Moore | 52/583 |
| 1,564,948 | 12/1925 | Copeman | 52/787 |
| 1,870,422 | 8/1932 | Reel | 52/583 |
| 1,982,217 | 11/1934 | Luehrs | 52/259 |
| 2,460,848 | 2/1949 | Rover | 52/787 |
| 2,482,339 | 9/1949 | Hibbard et al. | 52/309.2 |
| 2,920,475 | 1/1960 | Graham | 52/587 |
| 3,093,935 | 6/1963 | Dunn . | |
| 3,645,056 | 2/1972 | Gerola | 52/259 |
| 3,693,308 | 9/1972 | Trezzini et al. | 52/259 |
| 3,780,480 | 12/1973 | Cuijanovic et al. | 52/259 |
| 3,782,061 | 1/1974 | Minutoli et al. | 52/251 |
| 3,842,562 | 10/1974 | Daigle | 52/587 |
| 3,942,294 | 3/1976 | Savell, Jr. | 52/259 |
| 4,122,644 | 10/1978 | Woodruff | 52/787 |
| 4,273,818 | 6/1981 | Bucks | 52/787 |
| 4,554,196 | 11/1985 | Meeker | 52/787 |

FOREIGN PATENT DOCUMENTS

| | | | |
|---|---|---|---|
| 782660 | 6/1935 | France . | |
| 932379 | 3/1948 | France . | |
| 1134707 | 4/1957 | France | 52/787 |
| 328979 | 8/1935 | Italy . | |
| 671433 | 10/1964 | Italy . | |
| 240676 | 8/1925 | United Kingdom . | |
| 496235 | 11/1938 | United Kingdom . | |
| 562732 | 7/1944 | United Kingdom . | |
| 785499 | 10/1957 | United Kingdom . | |
| 1105033 | 3/1968 | United Kingdom . | |
| 2056538 | 3/1981 | United Kingdom . | |
| 1591359 | 6/1981 | United Kingdom . | |

*Primary Examiner*—William F. Pate, III
*Assistant Examiner*—Michael Safavi
*Attorney, Agent, or Firm*—Kerkam, Stowell Kondracki & Clarke

[57] ABSTRACT

The present invention provides a rectangular building panel having shoulders along two sides thereof and units embedded in the panel for securing shuttering to two panels placed side-by-side so that columns and beams may be cast in the space between the shuttering and the panels which, when set, support the panels.

4 Claims, 8 Drawing Figures

BUILDING PANEL

This application is a continuation-in-part of U.S. Ser. No. 462,434 filed 1/31/83, now U.S. Pat. No. 4,573,303—A method of casting foors and ceilings.

The present invention relates to a building panel for use in the method described in U.S. Ser. No. 462,434, now U.S. Pat. No. 4,573,303, the contents of which are incorporated herein by reference, and also in a method for constructing walls, and particularly walls of buildings.

The use of pre-cast building panels in the construction of walls and floors is known. For example, British Patent No. 240,678 describes the manufacture of walls using rectangular panels each having a tongue or a groove along its four sides which form tongue-and-groove joints with other identically-shaped panels to form an interlocked structure. A row of panels joined together at their sides is secured to a complete wall of shuttering by anchors one end of each of which engages in slots in a panel and the other end of which is nailed to the shuttering; the anchors ensure a gap between the shuttering and the row of panels and the gap is filled with concrete, following which a further row of panels is placed on, and interlocked with, the panels of the first row, anchors are used to fix the second row to the shuttering wall and a further amount of concrete is in-filled between the shuttering and the second row of panels. These steps are repeated for subsequent rows until a complete wall is built.

However, such an arrangement requires the use of a large quantity of concrete and also the panels can slip sideways on the concrete in-fill since the anchors do not provide an effective bar to such a movement. Finally, it is necessary to build a complete wall of shuttering which is time-consuming and expensive.

Pre-cast ceiling panel are known in a variety of shapes and the following patent specifications describe such panels: British Patent Specifications Nos. 496,235; 785,499; 1,105,033 and 1,591,359; Italian Patent Specification No. 671,433; French Patent Specifications Nos. 782,660 and 932,379; and U.S. Pat. No. 3,093,935. However, all these panels require elaborate systems of shuttering and cannot be used to form walls.

According to the present invention there is provided a rectangular precast panel for use in constructing walls and floors of buildings, which panel comprises a first and a second face that are opposed to each other, a pair of first opposed sides and a pair of second opposed sides, wherein:

(a) each first side has a shoulder spaced apart from the second face of the panel, one surface of which shoulder is flush with the first face of the panel;

(b) each second side is shaped to internest with a corresponding side of an identically-shaped panel;

(c) the panel further includes a plurality of engaging means, which are preferably nuts, embedded in the panel adjacent to each of said first sides, and bores extending from each engaging means to the said second face whereby bolts can be secured in the panels by engagement with said engaging means to hold shuttering against said second face.

Preferably, the nuts are anchored in the panels by means of plates attached to, or ingegral with, the nuts. Also, the panels may include a plurality of securing members each having an arm embedded in the panel and a hook part extending from one of the first sides or from the second face in the vicinity of one of the first sides.

The panels may be used to construct floors and ceilings of buildings as described in U.S. patent application Ser. No. 462,434 and British Published Application No. 2,115,031A and also to construct walls as is described below, by way of example, with reference to the accompanying drawings, in which.

FIGS. *7a* and *7b* are horizontal and vertical cross-sectional views (respectively) of a finished wall.

Figure 1:
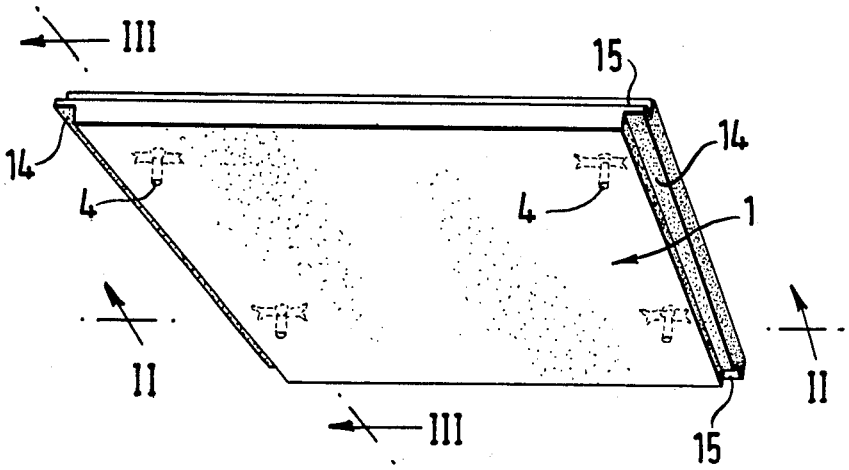
FIG. 1 is a perspective view of one form of the panel shown from below.
Figure 2:
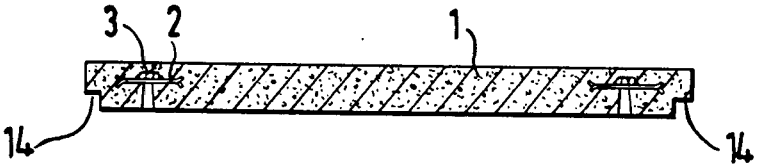
FIG. 2 is a sectional view along line II—II of FIG. 1.
Figure 3:
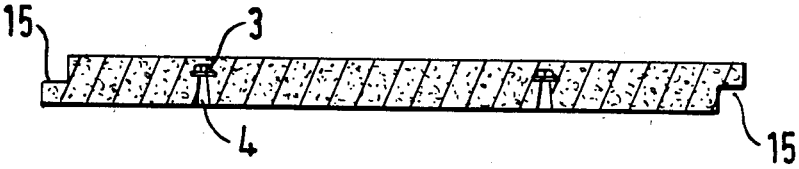
FIG. 3 is a hoizontal sectional view along lines III—III of FIG. 1.

A panel 1 of the present invention is shown in FIGS. 1 to 3. it is generally rectangular in shape (which term is intended to include a square shape) and it has embedded in it nuts 3 which are anchored in the panel by anchor plates 2 that are integral with or attached to the nuts 3, e.g. by welding. The panel has bores 4 through which the nuts are accessible; as will be described later, bolts may be passed through the bores 4 and screwed into nuts 3.

Looking generally at the panel shown in FIGS. 1 to 3, it has a pair of opposed first sides that are each provided with shoulders 14, the top surface of which shoulders are flush with the top surface of the panel (as shown in the drawings). The panel also has two opposed second sides, each provided with a step 15 so that identical panels 1 can be placed side-by-side with the steps 15 of two adjacent panels internesting.

Figure 4:
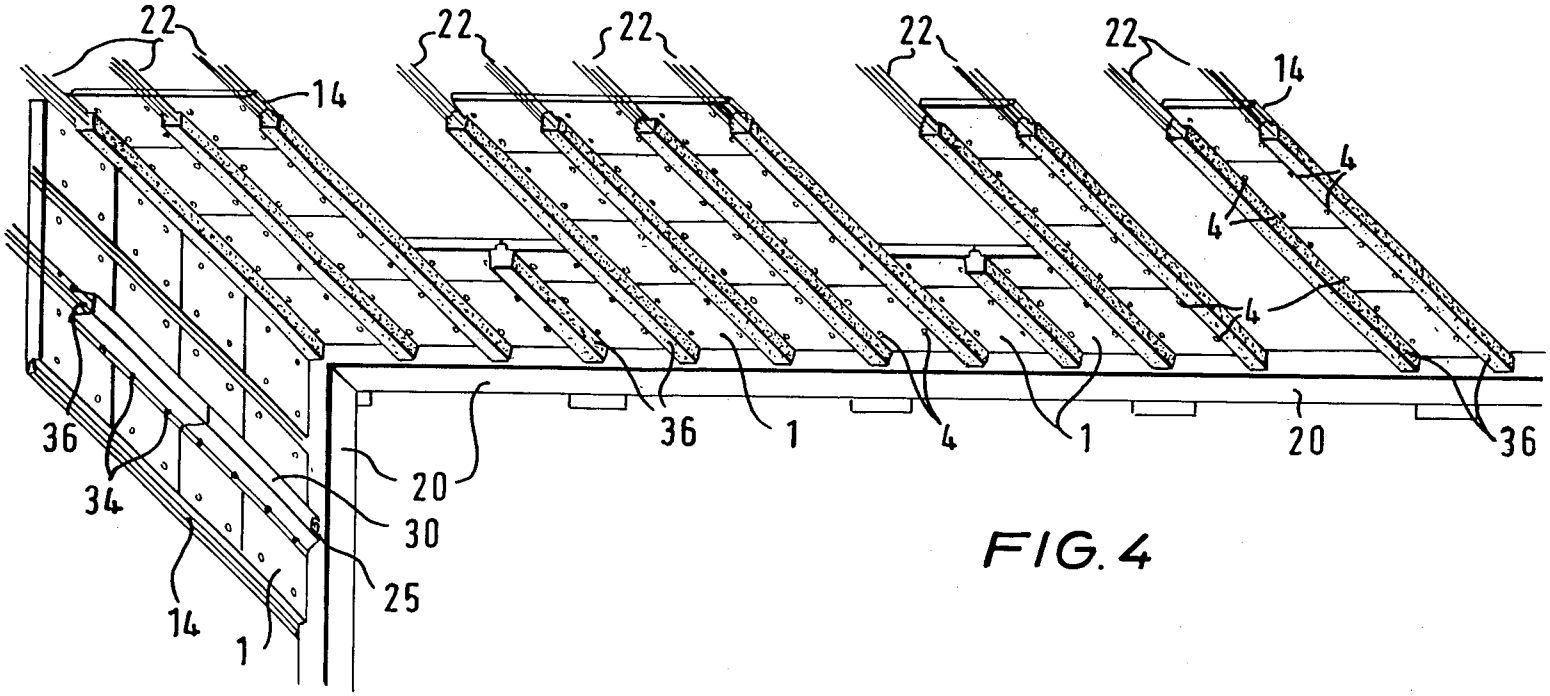
FIG. 4 is a perspective view of two walls in the course of construction.

Referring to FIG. 4, the first step in constructing a wall using panels of the present invention is to set a beam 20 in concrete foundations. The beam 20 has cast into it sets of reinforcing bars 22 regularly spaced along its length. The ends of the bars 22 must be set into the beam 20 with great accuracy to ensure that they are all parallel; this can be achieved by high-precision moulding techniques using a metallic template to position the bars 22. Also cast into the beam are tags 25 (shown in FIG. 4) one of which is located at the base of each set of beams. Each tag has a hole through it.

Figure 5:
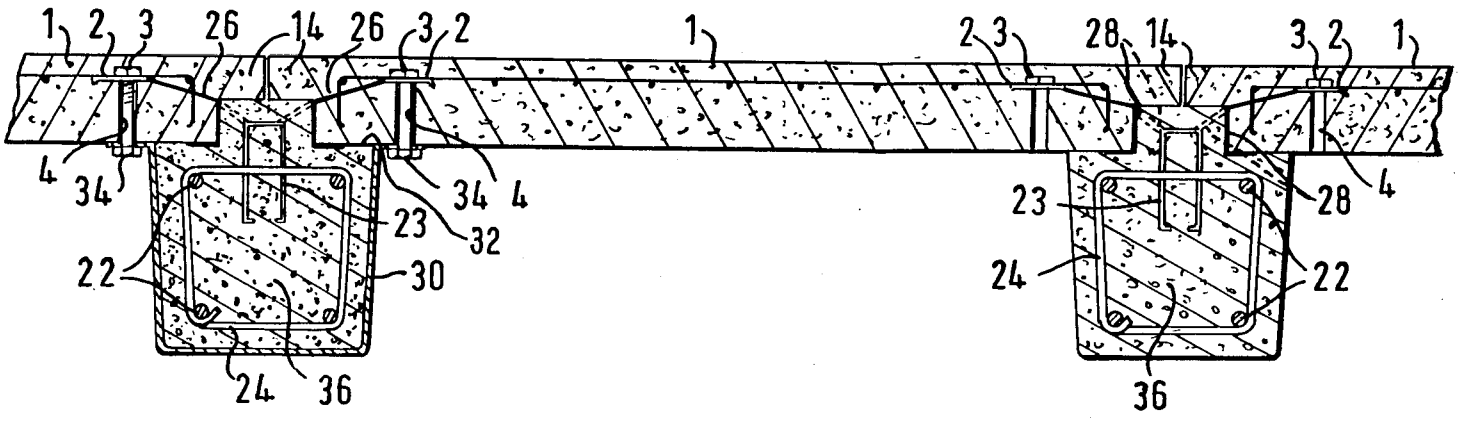
FIG. 5 is a sectional view through part of the wall in the course of construction.

Referring now to FIG. 5, which shows a cross-section of a constructed wall, the bars 22 are, as shown, arranged in sets of four, each set being held together with ties 24 to which anchor clips 23 are attached; alternatively the anchor clips 23 can be attached directly to the bars.

Panels 1 are positioned between adjacent sets of bars. These panels 1 are the same as those shown in FIGS. 1 to 3 except that they have hook members 26 joined to the anchor plates 2 embedded in the panel. The hook members 26, which are made of resilient material and extend from the sides of the panels just under shoulders 14, each have an outer end 28 that, before the panel is used, lies against the panel (as shown by solid lines) but can be hooked around an anchor clip 23 (as shown by dotted lines) to hold a panel onto the clip 23 and therfore onto the bars 22.

As shown in FIGS. 4 and 5, lengths of shuttering 30 are secured to the beam 20 by passing a bolt through the hole in the tag 25 and engaging it in a threaded bore in the shuttering as shown on the left-hand side of FIG. 4. Each length of shuttering 30 has flanges 32 along each side edge (see FIG. 5); the shuttering 30 bridges two panels 1 placed side-by-side and is secured to the panels 1 by means of bolts 34 engaged in the nuts 3 embedded in the panels, the heads of the bolts pressing the flanges of the shuttering against the panels as shown in the left-hand part of FIG. 5.

Referring again to FIGS. 4 and 5 and also to FIGS. *7a* and *7b*, the construction of a wall is started by setting beam 20 in foundations in the ground in such a way that the bars 22 are vertical. When the concrete foundations have set, a first row of panels 1 is placed on the beam 20 and is secured to the bars 22 by means of the hook members 26; also lengths of shuttering are secured to the tags 25 on the beam and to the panels 1 by means of the bolts 34 engaged in the nuts 3 in the panels. The panels are arranged with the steps 15 at the top and bottom of the panel—see FIG. *7b*. The shoulders 14 of adjacent panels 1 therefore abut and form an inwardly-facing recess which lies adjacent to one side of a set of bars 22. The set of bars 22 is enclosed on the side opposite to the recess by the shuttering 30 to provide a closed channel 36 into which concrete is poured. When this is set, another row of panels can be set on the first with the step 15 on the top of one panel of the first row engaging the step 15 on the bottom of the panel immediately above it in the second row. Further lengths of the shuttering 30 are secured if necessary to the first length of shuttering 30, and further concrete is poured into the resulting channels. In the same way, further rows of panels 1, can be built up to form a whole wall. The concrete cast in each channel 36 forms a column that supports the panels in the final wall. It is not necessary to build up only one row of panels before concrete is poured into the channels 36 and two or more rows may be set in place before the concrete is poured into the channels. In the illustrated embodiment, four rows of panels are used to make a wall but a greater or fewer number of panel rows can be used depending onthe height of wall desired and the size of thepanels.

Once the concrete of the whole wall making up a single storey has set, the shuttering 30 is removed to reveal cast concrete columns 36—see the right-hand side of FIG. 5.

Figure 6:
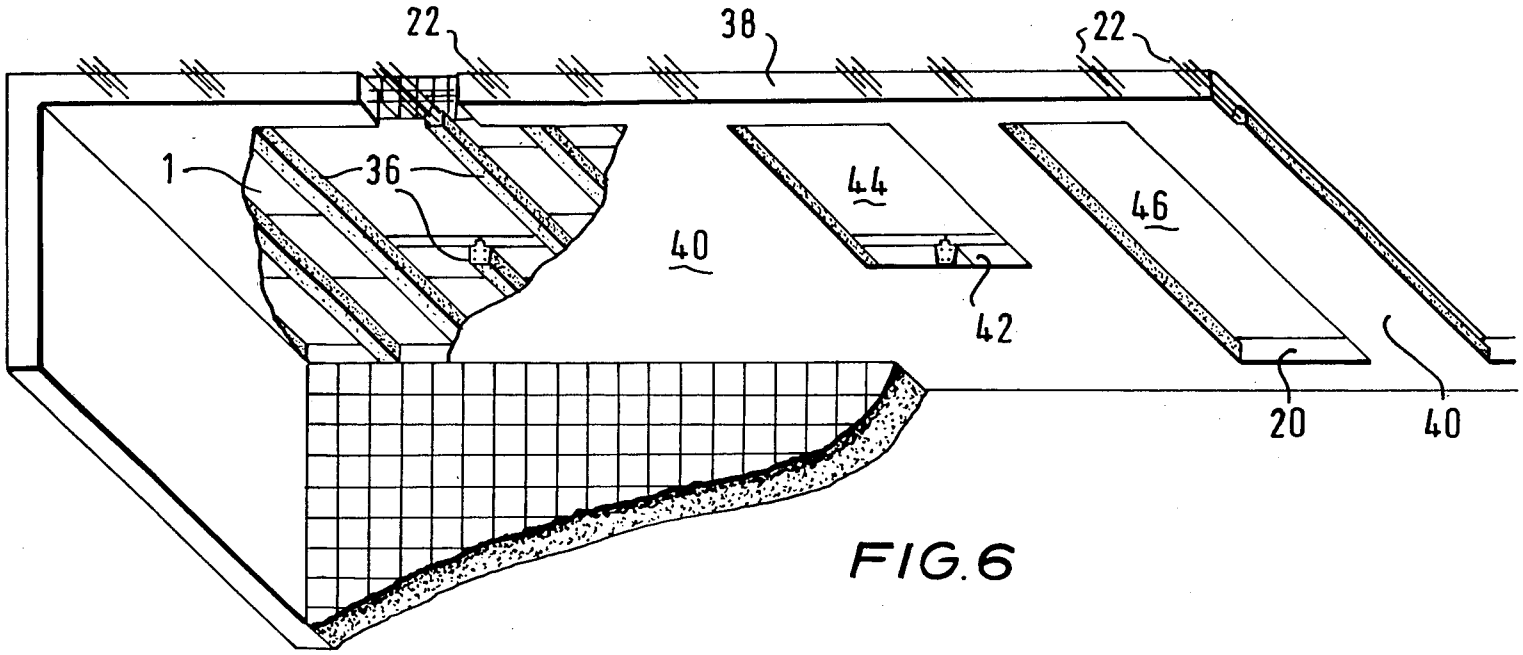
FIG. 6 is a perspective, partially cut away, view of the same walls as FIG. 4 but the walls are nearly complete.
Figures 7A, 7B:
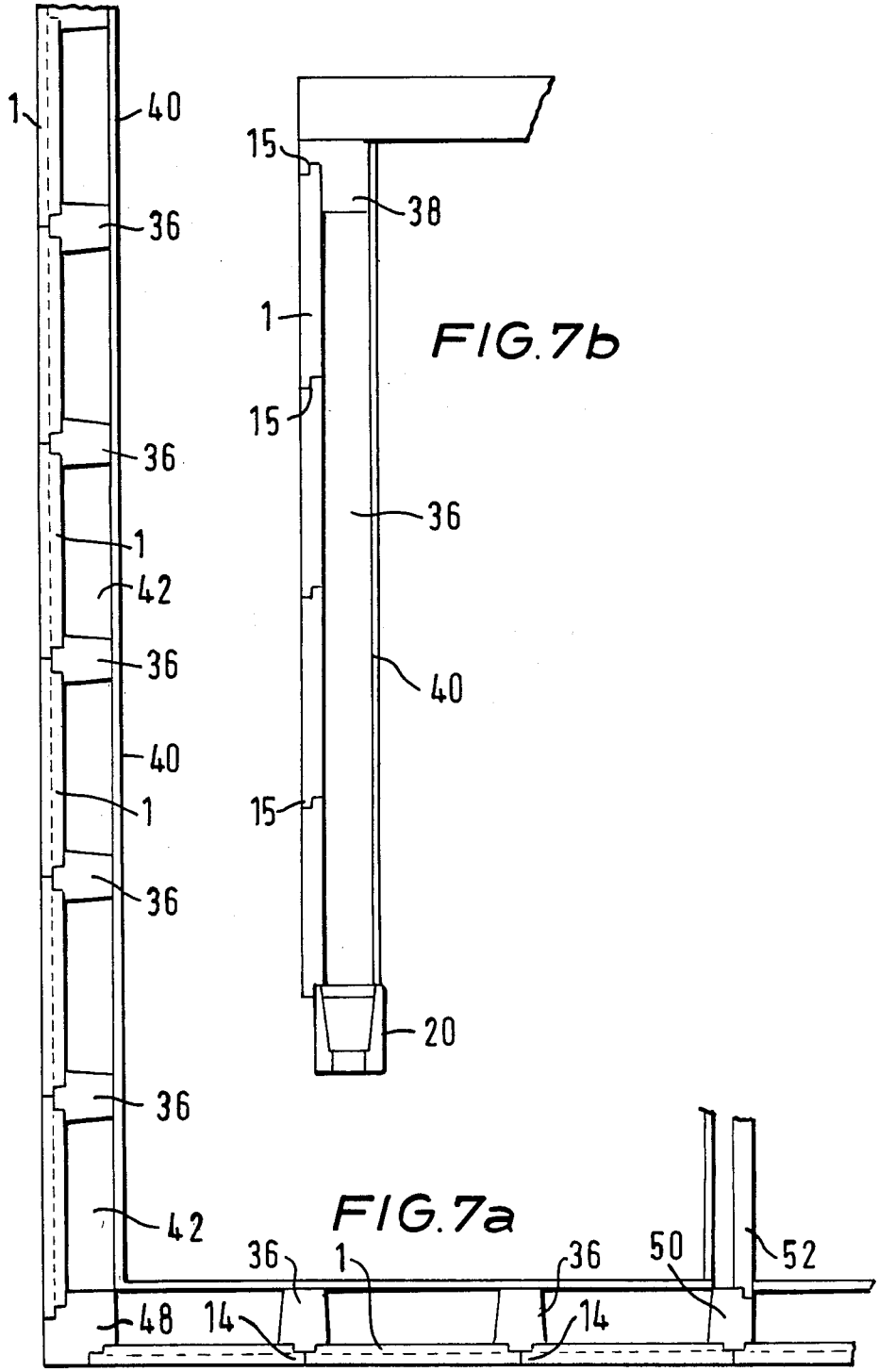

A second reinforced beam 38 is cast on top of the wall using normal casting techniques (see FIG. 6). The interior of the wall can be finished off by securing sheets, e.g. of plaster board, to the inside of the columns to provide a smooth wall surface 40. The cavity 42 between the panels 1 and the inner surface 40 can be filled with thermally insulating material.

At the places where it is desired to include windows and doors 44 and 46, an appropriate number of panels can be omitted, e.g. in the illustrated embodiment four panels can be omitted to form a door 46 and for a window 44 the upper two panels may be omitted. The lintels for the windows and doors are provided by beam 38.

Special corner columns 48 can be cast using external shuttering and in the same way, again using external shuttering, a column 50 supporting an internal wall 52 can be formed—see FIG. *7a*.

A ceiling can be placed on top of the beam 38, preferably using the method described in U.S. patent application Ser. No. 462,434, and following that the walls for the next storey can be constructed in the same way as the walls of the first storey. Four storey buildings can be constructed in this way that can withstand hurricane conditions.

The panels of the present invention are easily produced and are sufficiently light, e.g. about 40 pounds, to be readily transported and handled. The walls and ceiling/floors produced using the panels of the present invention, are light and yet robuts, they are cheap and easy to build, particularly since the same panels can be used for both walls and floors/ceilings, and require little skilled labour in their construction. Also the walls can have a large cavity for insulating materials and therefore have good insulating properties too.

I claim:

1. A rectangular precast panel for use in constructing walls and floors of buildings, which panel is made of a cement-based material and comprises a first and second face that are opposed to each other, a pair of first opposed sides and a pair of second opposed sides, wherein:

(a) each first side has a shoulder spaced apart from the second face of the panel, one surface of which shoulder is flush with the first face of the panel and there being a void between a second surface of said shoulder, opposite said one surface, and a plane of the second face of the panel;

(b) each second side is shaped to internest with a second side of an identically-shaped panel;

(c) the panel further includes a plurality of engaging means embedded in the panel adjacent to each of said first sides, and bores extending from each engaging means to the said second face whereby bolts can be secured in the panels by engagement with said engaging means to hold shuttering against said second face; said panel also including a plurality of securing members each having an arm embedded in the panel and a hook part extending from one of the first sides, said hook part being capable of hooking onto a structural member to engage the panel on the structural member.

2. A panel as claimed in claim 1, wherein the arm of each securing member is joined directly to one of said engaging means.

3. A panel as claimed in claim 1, wherein each engaging means is a nut.

4. A panel as claimed in claim 1, wherein the arm of each securing means is joined indirectly to one of said engaging means.

* * * * *